United States Patent [19]

Uemura et al.

[11] Patent Number: 4,575,411

[45] Date of Patent: Mar. 11, 1986

[54] PROCESS FOR PREPARING PRECURSOR PITCH FOR CARBON FIBERS

[75] Inventors: Seiichi Uemura, Tokyo; Shunichi Yamamoto, Kamakura; Takao Hirose, Kamakura; Hiroaki Takashima, Kawasaki; Osamu Kato, Yokohama, all of Japan

[73] Assignee: Nippon Oil Company, Limited, Japan

[21] Appl. No.: 673,578

[22] Filed: Nov. 21, 1984

[30] Foreign Application Priority Data

Jun. 15, 1982 [JP] Japan ..... 57-101377

[51] Int. Cl.[4] ..... C10C 1/00

[52] U.S. Cl. ..... 208/44; 208/39; 208/41; 208/22; 423/447.1; 423/447.4

[58] Field of Search ..... 208/44, 22, 39, 41; 423/447.4

[56] References Cited

U.S. PATENT DOCUMENTS

| | | | |
|---|---|---|---|
| 1,404,435 | 1/1922 | Gevers-Orban | 208/360 |
| 1,742,933 | 1/1930 | Pew, Jr. et al. | 208/360 |
| 1,794,542 | 3/1931 | Piron | 208/360 |
| 2,063,860 | 12/1936 | Wait | 208/360 |
| 2,076,498 | 4/1937 | Farwell | 208/360 |
| 2,095,470 | 10/1937 | Foley | 208/360 |
| 2,732,332 | 1/1956 | Ceeler | 208/360 |
| 4,032,430 | 6/1977 | Lewis | 423/447.1 |
| 4,042,486 | 8/1977 | Asano et al. | 208/44 |
| 4,208,267 | 6/1980 | Diefendorf et al. | 208/22 |
| 4,243,512 | 1/1981 | Seo | 208/39 |
| 4,259,171 | 3/1981 | Stadelhofer et al. | 208/45 |
| 4,271,006 | 6/1981 | Dickakian | 208/44 |
| 4,469,667 | 9/1984 | Uemura et al. | 208/22 |
| 4,470,960 | 9/1984 | Uemura et al. | 208/22 |

FOREIGN PATENT DOCUMENTS

| | | | |
|---|---|---|---|
| 113668 | 8/1941 | Australia | 208/360 |
| 411234 | 6/1934 | United Kingdom | 208/360 |
| 715316 | 9/1954 | United Kingdom | 208/360 |

*Primary Examiner*—John Doll
*Assistant Examiner*—Helane Myers
*Attorney, Agent, or Firm*—Scully, Scott, Murphy & Presser

[57] ABSTRACT

A precursor pitch for the production of carton fibers is obtained by heat-treating a carbonaceous pitch in the form of a thin film having a thickness not larger than 5 mm at a temperature in the range of 250° to 390° C. and under a reduced pressure not higher than 100 mmHg. By melt-spinning this precursor pitch and subjecting the resultant pitch fiber to infusiblization and carbonization and, if required, to subsequent graphitization, there is obtained a high quality carbon fiber.

5 Claims, No Drawings

PROCESS FOR PREPARING PRECURSOR PITCH FOR CARBON FIBERS

BACKGROUND OF THE INVENTION

The present invention relates to a process for preparing an improved precursor pitch for the production of carbon fibers of high quality.

There has been known a method of producing carbon fibers by melt-spinning a carbonaceous pitch, then rendering the resultant pitch fiber infusible and subjecting it to carbonization and, if required, to subsequent graphitization. In this connection, attempts have been made recently for improving the performance of carbon fibers as final product by subjecting such carbonaceous pitch to a physical or chemical treatment to thereby produce a pitch (hereinafter referred to as "precursor pitch") suitable for melt spinning.

As a method of producing the precursor pitch, there has been reported (U.S. Pat. Nos. 3,974,264, 3,995,014, 4,026,788, 4,032,430), for example, a method in which a carbonaceous pitch is heat-treated for a long time at a high temperature of around 400° C. under reduced pressure or while introducing an inert gas. The precursor pitch obtained by this method is a mesophase pitch containing 40–90 wt.% of a pyridine- or quinoline-insoluble mesophase. But this method is disadvantageous in point of economy because the manufacturing cost is high; besides, high molecular weight components such as pyridine-insoluble or quinoline-insoluble components are produced in large amounts because the heat treatment must be conducted for a long time at a high temperature. If such high molecular weight components are present in large amounts in the precursor pitch, not only it becomes difficult to perform a continuous spinning stably in the subsequent melt spinning step, but also the resultant carbon fiber will be badly affected in its physical properties.

Further, the precursor pitch obtained by this method has an extremely high softening point because it contains a large amount of a high molecular weight component. As the softening point of the precursor pitch becomes higher, the melt spinning temperature also becomes higher, thus resulting in that the high molecular weight component is further increased in molecular weight by polycondensation, and at the same time there arises the problem that the pitch undergoes a thermal decomposition, generating a light gas and making spinning virtually impossible.

There has also been reported a method in which light components contained in a carbonaceous pitch are removed in advance by solvent extraction or vacuum distillation and thereafter the carbonaceous pitch is heat-treated. But this method is not only disadvantageous in point of economy because it requires an additional step for removing such light components in advance, but also it is inferior in point of physical properties of carbon fibers as final product, that is, only carbon fibers of inferior physical properties have heretofore been obtained by such method.

All of the precursor pitches prepared according to those conventional methods are still unsatisfactory for the production of carbon fibers of high performance, and involve problems also in point of economy.

SUMMARY OF THE INVENTION

It is an object of the present invention to eliminate the above-mentioned drawbacks of the prior art methods.

It is another object of the present invention to provide a very economical process for preparing a precursor pitch having superior properties for the production of carbon fibers of high quality.

The above-mentioned objects of the present invention can be attained by a process for producing a precursor pitch for carbon fibers which process comprises heat-treating a carbonaceous pitch in the form of a thin film having a thickness not larger than 5 mm at a temperature in the range of 250° to 390° C. and under a reduced pressure not higher than 100 mmHg.

The thus-obtained precursor pitch of the present invention contains 40–100% of mesophase consisting of a quinoline-insoluble mesophase and a quinoline-soluble mesophase, the proportion of the quinoline-insoluble mesophase being 0–15 wt.%. The remaining optically isotropic phase substantially comprises quinoline-soluble components. And since the softening point of the precursor pitch of the present invention is usually in the range of 200° to 280° C., such problems as in the foregoing prior art in melt spinning do not occur.

According to the process of the present invention, since light components can be removed at a temperature lower than 400° C. and that in a short time, the production of undesirable high molecular components is largely suppressed and a precursor pitch superior in performance can be obtained in an extremely efficient manner.

The precursor pitch thus obtained is subjected to melt-spinning, infusibilization and carbonization and, if required, to subsequent graphitization to obtain carbon fiber.

DESCRIPTION OF PREFERRED EMBODIMENTS

Examples of the carbonaceous pitch used in the present invention include coal pitches such as coal tar pitch and coal liquefaction pitch, petroleum pitches such as ethylene tar pitch and decant oil pitch, as well as synthetic pitches, with petroleum pitches being particularly preferred.

It is also preferable in the present invention that the above pitches be subjected to a modification treatment before their use. As modified pitches which may be used in the invention, mention may be made of the starting pitches disclosed in Japanese Patent Laid Open Nos. 168987/1982, 168988/1982, 168989/1982, 168990/1982, 170990/1982, 179285/1982, 179286/1982, 179287/1982, 179288/1982, 19419/1983 and 18420/1983.

In general, carbonaceous pitches assume a solid state at room temperature, having softening points usually in the range of about 50° to about 200° C. In the present invention, first a carbonaceous pitch is melted into a liquid state and spread on a suitable base substrate in the form of a thin film. As to the thickness of the thin film, the smaller, the better, and it is not larger than 5 mm, preferably not larger than 3 mm. Then, the pitch thus spread in the form of a thin film on the base substrate is heat-treated at a temperature in the range of 250° to 390° C., preferably 280° to 370° C. and most preferably 300° to 360° C. and under a reduced pressure not higher than 100 mmHg, preferably not higher than 50 mmHg, to obtain the precursor pitch of the present invention.

The base substrate used for spreading the pitch in the form of a thin film is not specially limited provided it is formed of a material not badly affecting the pitch under the treating conditions. For example, glass, stainless steel and carbon steel are employable.

The precursor pitch obtained by the process of the present invention contains 40–100% of mesophase consisting of a quinoline-insoluble mesophase and a quinoline-soluble mesophase, the proportion of the quinoline-insoluble mesophase being 0–15 wt.%. The remaining optically isotropic phase substantially comprises quinoline-soluble components.

The precursor pitch prepared according to the process of the present invention has a softening point usually ranging from 200° to 280° C., and it is characteristic in that its content of quinoline insolubles is low, 0 to 15 wt.%, as compared with such softening point. In case the melt spinning is performed using the precursor pitch of the present invention, it is possible to effect a continuous spinning in an extremely stable manner and a fine fiber with a diameter of around 10μ is easily obtainable. And in case the resultant pitch fiber is rendered infusible in an oxidative gas atmosphere, then carbonized in an inert gas atmosphere and, if required, subsequently graphitized, there can be obtained a carbon fiber of extremely high performance having a tensile strength not lower than 200 kg/mm$^2$ and a tensile modulus of elasticity not less than 30 ton/mm$^2$.

The following working examples and comparative examples are given to further illustrate the present invention, but it is to be understood that the invention is not limited thereto.

EXAMPLE 1

A vacuum-distilled gas oil (VGO) from Arabic crude oil, after hydrogenation treatment, was subjected to catalytic cracking at 500° C. in the presence of a silica-alumina catalyst to obtain a heavy oil (A) with a boiling point not lower than 200° C., properties of which are as shown in Table 1.

The heavy oil (A) was heat-treated at 430° C. under a pressure of 10 kg/cm$^2$.G for 3 hours, and then this heat-treated oil was distilled at 250° C./1.0 mmHg to distill off light components to obtain a pitch (1) having a softening point of 92° C. and a benzene insolubles content of 19 wt.%.

The pitch (1) was melted, then spread on a base substrate in the form of a thin film having a thickness of 1 mm and heat-treated at 350° C. for 8 minutes under a pressure of 2 mmHg to afford a precursor pitch having a softening point of 278° C. and containing optically anisotropic portion of 85% and a quinoline insolubles content of 4 wt.%. The precursor pitch thus obtained was melt-spun at 338° C. by means of a spinning apparatus having a nozzle diameter of 0.2 mm and an L/D ratio of 2.0 to obtain pitch fiber with a diameter of 12μ. The thus-prepared pitch fiber was rendered infusible, carbonized and graphitized under the following conditions to obtain carbon fiber with a diameter of 11μ.

Infusiblization Condition: Heat in an air atmosphere at a rate of 3° C./min up to 200° C. and then 1° C./min up to 300° C., and hold at 300° C. for 15 minutes.

Carbonization Condition: Heat in a nitrogen atmosphere at a rate of 5° C./min and hold at 1,000° C. for 30 minutes.

Graphitization Condition: Heat in an argon gas stream up to 2,500° C. at a rate of 25° C./min.

The carbon fiber thus obtained proved to have a tensile strength of 250 kg/mm$^2$ and a tensile modulus of elasticity of 42 ton/mm$^2$.

TABLE 1

| Properties of heavy oil (A) | | |
|---|---|---|
| Specific Gravity (15° C./4° C.) | | 0.965 |
| Distillation Property | Initial boiling point | 320 ° C. |
| | 5% | 340 |
| | 10% | 353 |
| | 20% | 370 |
| | 30% | 385 |
| | 40% | 399 |
| | 50% | 415 |
| | 60% | 427 |
| | 70% | 445 |
| | 80% | 467 |
| | 90% | 512 |
| Viscosity cSt @ 50° C. | | 18.21 |

EXAMPLE 2

A heavy oil (B), properties of which are shown in Table 2, with a boiling point not lower than 200° C. by-produced in steam cracking of naphtha at 830° C. was heat-treated at 400° C. for 3 hours under a pressure of 15 kg/cm$^2$.G, and then this heat-treated oil was distilled at 250° C./1 mmHg to obtain a fraction (C) having a boiling range of 160° to 400° C., properties of which are set out in Table 3. The fraction (C) was contacted with hydrogen at a temperature of 330° C., a pressure of 35 kg/cm$^2$.G and a liquid hourly space velocity (LHSV) of 1.5 in the presence of a nickel-molybdenum catalyst (NM-502), thereby allowing a partial nuclear hydrogenation to take place, to obtain a hydrogenated oil (D). The percentage nuclear hydrogenation was 31%.

30 parts by volume of the heavy oil (A) used in Example 1, 60 parts by volume of the above heavy oil (B) and 10 parts by volume of the above hydrogenated oil (D) were mixed and heat-treated at 430° C. for 3 hours under a pressure of 20 kg/cm$^2$.G, and the thus heat-treated oil was distilled at 250° C./1.0 mmHg to distill off light components to obtain a pitch (2) having a softening point of 80° C. and a benzene insolubles content of 22 wt.%.

The pitch (2) was melted and spread in the form of a thin film with a thickness of 1 mm on a base substrate, then heat-treated at 350° C. for 9 minutes under a pressure of 1 mmHg to obtain a precursor pitch having a softening point of 270° C. and containing optically anisotropic portion of 81% and a quinoline insolubles content of 5 wt.%. This precursor pitch was melt-spun at 330° C. by means of the spinning apparatus used in Example 1 to obtain pitch fiber with a diameter of 12μ. The pitch fiber thus prepared was rendered infusible, carbonized and graphitized in the same manner as in Example 1 to obtain carbon fiber with a diameter of 11μ.

The carbon fiber thus obtained proved to have a tensile strength of 247 kg/mm$^2$ and a tensile modulus of elasticity of 43 ton/mm$^2$.

TABLE 2

| Properties of heavy oil (B) | | |
|---|---|---|
| Specific Gravity (15° C./4° C.) | | 1.039 |
| Distillation Property | Initial boiling point | 192° C. |
| | 5% | 200 |
| | 10% | 206 |
| | 20% | 217 |
| | 30% | 227 |

TABLE 2-continued

| Properties of heavy oil (B) | | |
|---|---|---|
| | 40% | 241 |
| | 50% | 263 |
| | 60% | 290 |
| | 70% | 360 |

TABLE 3

| Properties of fraction (C) | | |
|---|---|---|
| Specific Gravity (15° C./4° C.) | | 0.991 |
| Refractive Index ($n_D^{25}$) | | 1.5965 |
| Molecular Weight | | 145 |
| Distillation | Initial boiling point | 160° C. |
| Property | 10% | 200 |
| | 30% | 215 |
| | 50% | 230 |
| | 70% | 256 |
| | 90% | 305 |

EXAMPLE 3

The pitch (1) used in Example 1 was melted and spread in the form of a thin film with a thickness of 1 mm on a base substrate, then heat-treated at 350° C. for 4 minutes under a pressure of 2 mmHg to obtain a precursor pitch having a softening point of 270° C. and containing optically anisotropic portion of 65% and a quinoline insolubles content of 2 wt.%. This precursor pitch was melt-spun at 330° C. by means of the spinning apparatus used in Example 1 to obtain pitch fiber. The pitch fiber thus-prepared was rendered infusible, carbonized and graphitized in the same manner as in Example 1 to obtain carbon fiber.

The carbon fiber thus obtained proved to have a tensile strength of 230 kg/mm$^2$ and a tensile modulus of elasticity of 39 ton/mm$^2$.

EXAMPLE 4

The pitch (2) used in Example 2 was melted and spread in the form of a thin film with a thickness of 1 mm on a base substrate, then heat-treated at 350° C. for 13 minutes under a pressure of 1 mmHg to obtain a precursor pitch having a softening point of 275° C. and containing optically anisotropic portion of 95% and a quinoline insolubles content of 6 wt.%. This precursor pitch was melt-spun at 340° C. by means of the spinning apparatus used in Example 1 to obtain pitch fiber. The pitch fiber thus-prepared was rendered infusible, carbonized and graphitized in the same manner as in Example 1 to obtain carbon fiber.

The carbon fiber thus obtained proved to have a tensile strength of 243 kg/mm$^2$ and a tensile modulus of elasticity of 44 ton/mm$^2$.

COMPARATIVE EXAMPLE 1

The same pitch (1) as used in Example 1 was heated at a rate of 5° C./min up to 415° C. in a nitrogen atmosphere and under a pressure of 1 mmHg, and hold at 415° C. for 5 hours to obtain a mesophase pitch having a softening point of 320° C. and a pyridine insolubles (mesophase) of 69 wt.%.

The thus prepared mesophase pitch was melt-spun at 380° C. by means of the spinning apparatus used in Example 1 to obtain pitch fiber with a diameter of 12$\mu$, which was then rendered infusible, carbonized and graphitized in the same manner as in Example 1 to obtain carbon fiber with a diameter of 10$\mu$.

The carbon fiber thus obtained proved to have a tensile strength of 165 kg/mm$^2$ and a tensile modulus of 40 ton/mm$^2$.

What is claimed is:

1. A process for preparing a precursor pitch for the production of carbon fibers comprising forming a carbonaceous pitch into a thin film having a thickness not greater than 5 mm and treating said carbonaceous pitch film at a temperature of 250°–390° C. and at a reduced pressure not higher than 100 mmHg for a time sufficient to produce a precursor pitch containing 40–100% of mesophase having a softening point of 200°–280° C. and consisting of a quinoline-insoluble optical anisotropic phase and a quinoline-soluble anisotropic phase, the proportion of said quinoline-insoluble mesophase being 0–15 wt.%.

2. The process of claim 1, wherein said carbonaceous pitch in the form of a thin film has been obtained by melting a carbonaceous pitch into a liquid state and spreading the liquid carbonaceous pitch on a base substrate.

3. The process of claim 1, wherein said carbonaceous pitch in the form of a thin film has a thickness not larger than 3 mm.

4. The process of claim 1, wherein said reduced pressure is not higher than 50 mmHg.

5. The process of claim 1, wherein said heat treatment is carried out at a temperature in the range of 300° to 360° C.

* * * * *